United States Patent [19]

Borona

[11] 4,278,859

[45] Jul. 14, 1981

[54] CIRCUIT BREAKER STRUCTURE

[75] Inventor: Russell T. Borona, Seymour, Conn.

[73] Assignee: Westinghouse Electric Corp., Pittsburgh, Pa.

[21] Appl. No.: 970,046

[22] Filed: Dec. 15, 1978

[51] Int. Cl.[3] ..... H01H 33/04

[52] U.S. Cl. ..... 200/144 R; 200/144 C

[58] Field of Search ..... 200/146 R, 144 R, 144 C

[56] References Cited

U.S. PATENT DOCUMENTS

| | | | |
|---|---|---|---|
| 2,707,218 | 4/1955 | Cellerini | 200/144 R |
| 3,492,614 | 1/1970 | De Angelo et al. | 335/191 |
| 4,086,460 | 4/1978 | Gillette | 200/146 R |

*Primary Examiner*—Robert S. Macon

*Attorney, Agent, or Firm*—L. P. Johns

[57] ABSTRACT

A circuit breaker structure having improved insulation means between the conductors which support the stationary and movable contacts to reduce or eliminate arc restriking conditions.

3 Claims, 4 Drawing Figures

CIRCUIT BREAKER STRUCTURE

BACKGROUND OF THE INVENTION

1. Field of the Invention

This invention relates to a circuit breaker having improved means for eliminating arc restriking conditions.

2. Description of the Prior Art

Previous technology for separating electrical contacts of a two-pole, single phase, 120/240 volt circuit breaker is not applicable for a three-phase, 240 volt device. Short circuit interruption indicates that electrical restriking occurs between the moving arm and the stationary bus at various locations for the three-phase, 240 volt device. U.S. Pat. No. 3,492,614 discloses a typical two-pole, single phase, 120/240 volt breaker of prior construction. The disadvantage of arc restriking conditions required changes in the circuit breaker of the prior construction in order to provide a satisfactory three-phase, 240 volt device.

SUMMARY OF THE INVENTION

It has been found in accordance with this invention that problems inherent in the prior art may be overcome by providing a circuit breaker comprising a stationary contact, a movable contact, a contact arm carrying said movable contact, the stationary contact being mounted on a bus, the bus having a side surface facing the contact arm, a trip structure, a manually operable operating member movable to a closed position, an insulating member between the bus and the contact arm which member comprises a strip of dielectric, heat-resistant material mounted on the bus and extending from the stationary contact, an end portion of the strip adjacent to the stationary contact being secured in place by a tape wrapped around the assembled strip and base, and the tape comprising a gas emitting ingredient activated by heat to create a gaseous atmosphere between the bus and the contact arm to minimize arc restriking conditions.

The advantage of the circuit breaker structure of this invention is that it is an improvement over circuit breakers of prior art construction because arc restriking conditions are eliminated.

DESCRIPTION OF THE PREFERRED EMBODIMENT

Figure 1:
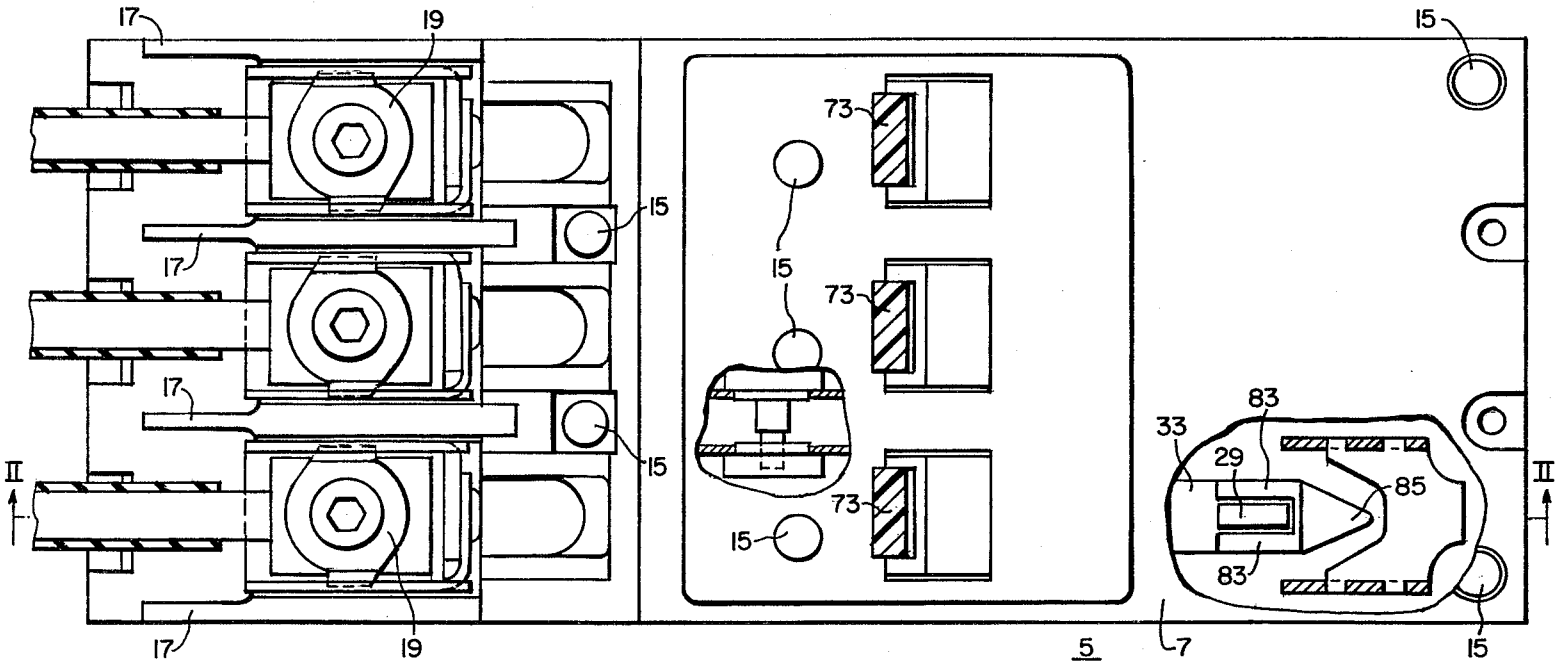
FIG. 1 is a top plan view of a multi-pole circuit breaker constructed in accordance with the principles of this invention.

In the drawings, a circuit breaker is generally indicated at 5 and it comprises an insulating housing 7 and a circuit breaker structure 9 supported within the housing.

The insulating housing 7 is a two-part housing comprising a base 11, having a generally planar bottom, and a cover 13 secured to the base by suitable means such as spaced rivets 15. The base 11, at one end thereof, comprises insulating barriers 17 forming three adjacent cavities. The cavities are open at the top and open at one end of the housing for receiving three clamp-type terminals 19 that are used to connect conducting lines to the multi-pole units. The terminals 19 are more specifically described in the U.S. Pat. No. 3,559,156 of Kenneth R. Coley. The base 11 and the cover 13 cooperate to form three adjacent compartments 21 for housing the circuit breaker parts of the multi-pole units.

Figure 2:
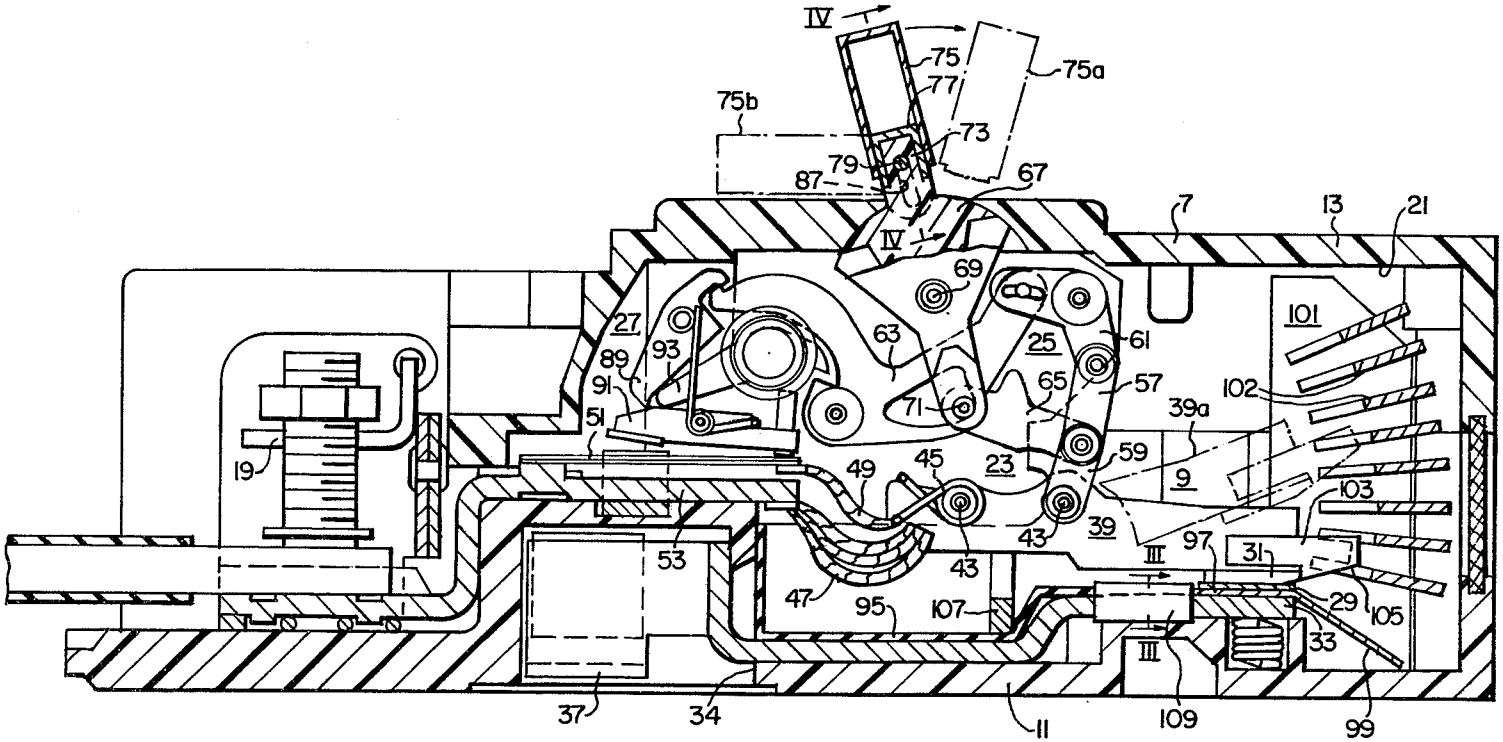
FIG. 2 is a sectional view taken generally along the line II—II of FIG. 1 showing the breaker in a closed position.

Each of the circuit breaker structures 9 comprises an operating mechanism 23, trip structure 25, and a trip device 27. A separate circuit breaker structure 9 is supported in each of the compartments 21. Since the parts of the multi-pole units of the circuit breaker are identical, only a single pole unit as shown in FIG. 2 is described. Inasmuch as the circuit breaker is similar in construction and operation to that disclosed in U.S. Pat. No. 3,492,614, entitled "Circuit Breaker With Thrust Transmitting Operating Mechanism", the description is limited herein to the basic structure and operation.

The operating mechanism 23 (FIG. 2) comprises a stationary contact 29 and a movable contact 31. The contact 29 is secured on a fixed conductor or bus 33 that extends across the base 11 to a cavity 34, formed in the base, where the bus is connected to or is part of a clip-on type terminal 37 that is located within the cavity. The cavity is open at the bottom of the base 11 for receiving a stab conductor that would protrude into the cavity 34 to be engaged by the clip-on type terminal 37. The movable contact 31 is mounted on an elongated contact arm 39. The arm 39 has a pin hole (not shown) for receiving a supporting pin 43. A torsion spring 45 biases one end of the contact arm to an open position **39*a* shown in broken line in FIG. 2. In the closed position of the contacts 29, 31 a circuit extends from the plug-in line terminal 37 through the bus 33, contacts 29, 31, contact arm 39, parallel flexible conductors 47, 49, parallel conductors 51, 53 through the left-hand part (FIG. 2) of the conductor 53 to a conducting line that may be connected to the conductor 53 by means of a clamp-type terminal connector 19**.

The trip structure 25 comprises toggle links 57, 59, an angle link 61, a releasable trip member 63, and a link 65. The several parts 57–65 are interconnected at pivot points as shown in FIG. 2. Manual operation of the circuit breaker 5 is provided by an insulating operating member 67 which is pivotally mounted at 69 and which is pivotally connected by a pin 71 to the link 65. The outer end of each operating member 67 includes a handle 73 that is movable singly. Or all of the handles 73 are tied together by a tie member 77, whereby all of the operating members 67 of the several circuit breaker structures 9 are manually movable simultaneously between the "ON" (FIG. 2) and the "OFF" position as shown by the broken line position **75*a***.

Figure 4:
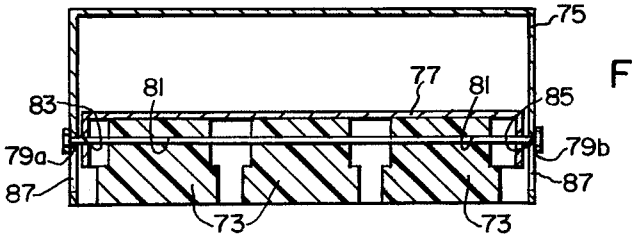
FIG. 4 is a vertical sectional view taken on the line IV—IV of FIG. 2.

All of the handles 73 are moved simultaneously between "OFF" and "ON" positions by a retractable handle extension 75 (FIGS. 2 and 4). The extension is secured in place by the tie member 77 that fits snugly over the three switch handles 73 of the circuit breaker parts of the multi-pole unit. The tie member 77 is a U-shaped member that clampingly engages and extends across the aligned handles (FIG. 4). A pivot pin 79 extends through aligned holes 81 in the handles 73 and has end portions **79*a* and 79*b* extending through openings 83 and 85 in opposite ends of the tie member 77. In addition, the portions 79***a* and 79*b* extend through similar slots 87 in opposite end walls of the extension 75.

As shown in FIG. 2 the U-shaped extension 75 fits snugly on tie member 77 for moving the several handles 73 between the "ON" position and the "OFF" (broken line) position 75*a*. When the extension is not in use, it may be moved to a position 75*b* where it is disposed against the surface of the circuit breaker 11. For that purpose the handle extension 75 is pulled off of the tie member 77 with the slots 87 moving along the end portions 79*a* and 79*b* of the pin 79 whereupon the extension is rotated to the position 75*b*.

The trip device 27 comprises a latch lever 89, a latch 91, and a cam 93 as shown in FIG. 2. As set forth above, the several parts of the trip structure 25 and the trip device are operable in the manner disclosed in U.S. Pat. No. 3,492,614, the teachings of which are incorporated by reference herein.

In accordance with this invention, the conductor or bus 33 (FIG. 2) comprises insulating means for minimizing arc restriking conditions between the bus and the contact arm 39. To avoid the occurrence of restriking of an arc between the opposing surfaces of the bus 33 and the contact arm 39, an insulating member 95 is mounted on the upper surface of the bus 33. As shown in FIG. 2, an arc runner 97 is disposed on the bus 33 and around stationary contact 29, there being good electrical contact between the parts 29, 33, and good mechanical strength between parts 97 and 33, such as that obtained by welding or brazing the inner surfaces thereof. The arc runner 97 includes an extension 99 which extends downwardly and outwardly from the right end of the contact 29 and preferably below the zone of an arc-extinguishing structure 101 for extinguishing arcs drawn between the contacts 29, 31 during opening operation thereof. Likewise, the contact arm 39 comprises an extension 103 having an outwardly and upwardly inclined surface 105 which functions in conjunction with the extension 99 to transfer an arc to the arc-extinguishing structure 101.

The right end of the insulating member 95 is in end-to-end abutment with the left end of the arc runner 97 and the left end portion of the insulating member 95 extends along the horizontal surface of the bus 33 and extends under a hold-down member 107 between mechanism 23, bus 33, and the flexible conductors 47, 49, as shown in FIG. 2. One form of the insulating member 95 comprises a strip of rag fiber or rag base paper which is pressure fitted onto the upper surface of the bus 33 as well as on the opposite vertical side walls to prevent an arc from running back to a shorter electrical path between the separating contact arm 39 and the bus 33.

Figure 3:
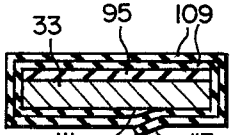
FIG. 3 is a vertical sectional view taken on the line III—III of FIG. 2.

Another form of the insulating member 95 comprises the strip of insulator in which the right end portion is preferably secured in place adjacent to the arc runner 97 by a strip of electrical tape 109 which is wrapped around the assembly of the member 95 and the bus 33 substantially as shown in FIG. 3. For best results the tape 109 is wrapped around the assembly of the bus 33 and the insulating member 95 in at least two revolutions with tape end portions 111, 113 being disposed at the under surface of the bus 33, in order to prevent the tape end portions from becoming loose in the space between the bus 33 and the conductor arm 39.

In another form, the insulating member 95 is comprised of the insulating tape material and being co-extensive with the bus 33 between the end of the runner 97 and the left end of the strip (FIG. 2). The tape 109 may or may not be added for holding the end portion of the member 95 in place adjacent to the runner 97.

The advantage of the use of an insulator in the form of an electrical tape is improved electrical interruption properties inherent in the tape. Certain so-called electrical tapes are not satisfactory and include a cloth electrical tape and a plastic tape, neither of which is fire retardant because they melt at relatively low temperatures.

The preferred type of electrical tape is a glass fiber cloth tape which withstands higher temperatures and therefore does not burn in the atmosphere of the arc. A glass fiber electrical tape comprises glass fibers and a filler which when subjected to the temperatures induced by an arc emits a gas during short circuit conditions which offers improved arc voltage conditions and thereby contributes to arc interruption. An example of a filler is aluminum trihydrate or hydrated alumina, $Al(OH)_3$. A typical tape of the glass fiber type is "Scotch 27" which is a trademark of a glass cloth electrical tape made by Electro-Products Division of the 3M Company. It is a high temperature tape with thermosetting pressure-sensitive adhesive on one side and adapted to operate at temperatures up to about 130° C. (266° F.).

Also in accordance with this invention, the lengths of the bus 33 and the contact arm 39 is increased over corresponding members of prior construction, such as shown in U.S. Pat. No. 3,492,614, in order to separate the contacts 29, 31 a greater distance within the same time; or about ½ electrical cycle or 8 milliseconds. In conjunction with lengthening of the contact arm 39, deion plates 102 of the arc-extinguishing structure 101 are shortened.

In conclusion, with prior constructions of the circuit breaker an electrical arc tended to remain in the area of the parting contacts. Due to the insulating structure and its associated gassing, a magnetic force is generated that blows an arc into the deion plate structure causing low interruption times and less $I^2T$ energy let through with the ability to have successful repeated interruptions. Thus, the complete insulation of the bus member up to the contact comprises an improved method for obtaining increased magnetic forces as well as eliminating restrike potentials in the circuit breaker.

What is claimed is:

1. A circuit breaker comprising a stationary contact, a movable contact, a contact arm carrying said movable contact, the stationary contact being mounted on a bus, the bus having a side surface facing the contact arm, a manual operating member movable to a closed position, an insulation member between the bus and the contact arm, the insulation member comprising a dielectric, heat-resistant material mounted on the bus and extending from the stationary contact, and end portion of the member adjacent to the stationary contact being secured in place by a tape wrapped around the assembled member, and the bus and the tape comprising a gas-emitting ingredient activated by heat to create a gaseous atmosphere between the bus and the contact arm to minimize arc restriking conditions.

2. The circuit breaker of claim 1 wherein the tape comprises a high temperature material with thermosetting pressure-sensitive adhesive on one side and adapted to operate at temperatures up to about 130° C.

3. The circuit breaker of claim 1 wherein the tape is a glass fiber electrical material including a filler comprised of aluminum trihydrate.

* * * * *